US008185976B2

(12) United States Patent
Le et al.

(10) Patent No.: US 8,185,976 B2
(45) Date of Patent: May 29, 2012

(54) FLUSH VALVE MECHANISM

(75) Inventors: Tuan Le, Diamond Bar, CA (US); Bryan Janish, Carlsbad, CA (US); Robert Collin, Lake Forest, CA (US); Bill DeKeyser, Rancho Santa Margarita, CA (US)

(73) Assignee: Fluidmaster, Inc., San Juan Capristrano, CA (US)

( * ) Notice: Subject to any disclaimer, the term of this patent is extended or adjusted under 35 U.S.C. 154(b) by 988 days.

(21) Appl. No.: 12/172,926

(22) Filed: Jul. 14, 2008

(65) Prior Publication Data

US 2009/0025130 A1 Jan. 29, 2009

Related U.S. Application Data

(60) Provisional application No. 60/959,991, filed on Jul. 18, 2007.

(51) Int. Cl.

| | |
|---|---|
| ***E03D 3/12*** | (2006.01) |
| ***E03D 1/14*** | (2006.01) |
| ***E03D 1/34*** | (2006.01) |
| ***E03D 1/35*** | (2006.01) |

(52) U.S. Cl. ..... 4/324; 4/384; 4/391; 4/381; 4/395

(58) Field of Classification Search ..... 4/324–325, 4/378, 384–386, 381, 391, 395–396

See application file for complete search history.

(56) References Cited

U.S. PATENT DOCUMENTS

| | | | | | |
|---|---|---|---|---|---|
| 3,790,968 | A | * | 2/1974 | Pfeifer | 4/314 |
| 4,566,140 | A | * | 1/1986 | Musgrove | 4/324 |
| 4,882,793 | A | * | 11/1989 | Thompson | 4/324 |
| 4,916,762 | A | | 4/1990 | Shaw | |
| 5,023,960 | A | | 6/1991 | Ratanagsu | |
| 5,157,795 | A | * | 10/1992 | Pasquin | 4/324 |
| 5,265,282 | A | * | 11/1993 | Schmucki | 4/325 |
| 5,396,665 | A | * | 3/1995 | Raz et al. | 4/325 |
| 5,657,494 | A | * | 8/1997 | Diethelm | 4/324 |
| 5,659,903 | A | * | 8/1997 | Hammarstedt | 4/325 |

OTHER PUBLICATIONS

Notification of Transmittal of the International Search Authority, Written Opinion for International Application No. PCT/US08/70005 dated Oct. 22, 2008, 9 pages.

* cited by examiner

*Primary Examiner* — Jeanette Chapman
(74) *Attorney, Agent, or Firm* — Gordon & Rees LLP

(57) ABSTRACT

A flush valve is provided for flushing a toilet bowl. The flush valve includes a center tube having a lug, a flush activation device configured to initially raise the center tube, at least one latching mechanism configured to control movement of the center tube, and at least one rack configured to have movement controlled by the at least one latching mechanism. The at least one latching mechanism controls volume of fluid used during a flush.

4 Claims, 7 Drawing Sheets

FLUSH VALVE MECHANISM

RELATED APPLICATIONS

This application relates to, claims priority from, and incorporates herein by reference, as if fully set forth, U.S. Provisional Patent Application Ser. No. 60/959,991, filed on Jul. 18, 2007 and entitled "FLUSH VALVE MECHANISMS."

BACKGROUND

1. Field

The present embodiments relate generally to toilet flush valves.

2. Description of Prior Art and Related Information

A toilet tank typically employs a flush valve that is forced open, which remains open until a predetermined amount of water flows from the tank into the toilet bowl through the flush valve. A fill valve provides water from a supply line to the toilet tank. The fill valve is open whenever the water level in the tank is below a predetermined level.

In a dual flush valve toilet assembly, a toilet bowl is normally refilled during the time the toilet tank is filled up by water from a fill valve. The amount of water used to refill a toilet bowl must be enough to seal off the trap way of the bowl. This amount usually is determined as a percentage of the total flow volume of a fill valve during a flush cycle. This water is tapped from a port of a fill valve and fed to the tank bowl through a flexible tube, running down an overflow tube of a flush valve.

Flush valves are specifically designed for the size of a tank. This makes a flush valve designed for a specific size tank to not be able to be used for a different size tank.

BRIEF SUMMARY

One aspect provides a flush valve for flushing a toilet bowl. The flush valve includes a center tube having a lug, a flush activation device configured to initially raise the center tube, at least one latching mechanism configured to control movement of the center tube, and at least one rack configured to have movement controlled by the at least one latching mechanism. The at least one latching mechanism controls volume of fluid used during a flush.

In one embodiment the flush valve further includes a float-weight tube coupled to the rack. In another embodiment the float-weight tube is configured to force the rack to move vertically based on fluid level in a toilet tank. In yet another embodiment the at least one latching mechanism is a gear including a plurality of lugs. In still another embodiment each lug of the plurality of lugs is associated with a different latching state of the center tube. In one embodiment the gear is replaceable with another gear including a different number of lugs, wherein the flush valve device is scalable to different sized tanks based on the number of lugs. In another embodiment the at least one latching mechanism is a hook device. In still another embodiment rotation of the hook device is associated with a different latching state of the center tube. In yet another embodiment the hook device is replaceable with another hook device having a different length, wherein the flush valve device is scalable to different sized tanks based on the length of a hook device. In another embodiment the flush valve further includes another latching mechanism, another rack and another float-weight cup to counter the movement of the at least one latching mechanism, the rack and the float-weight cup.

Another aspect provides a method of flushing fluid in a toilet. The method includes providing a tank coupled to a bowl, activating a flush cycle by initially raising a center tube in the tank, and controlling movement of the center tube with at least one rotating latching mechanism. The rotating latching mechanism controls volume of fluid used during flushing of the bowl.

In one embodiment the at least one rotating latching mechanism is a gear including a plurality of lugs. In another embodiment each lug of the plurality of lugs is configured to control a different latching state of the center tube. In yet another embodiment the gear is replaceable with another gear including a different number of lugs. In still another embodiment the at least one latching mechanism is a hook shaped device. In one embodiment rotation of the hook shaped device controls different latching states of the center tube. In another embodiment the hook shaped device is replaceable with another hook shaped device having a different perimeter length.

Still another aspect provides a toilet system. The system including a tank coupled to a bowl, the tank including a flush valve device. The flush valve device including a center tube having a lug, a flush activation device configured to initially raise the center tube, at least one latching mechanism configured to control vertical movement of the center tube, and at least one rack frictionally coupled to the at least one latching mechanism and coupled to the center tube. The at least one latching mechanism controls volume of fluid used during a flush.

In one embodiment the system further includes a float-weight tube coupled to the rack. In another embodiment the float-weight tube is configured to force the rack to move vertically based on fluid level in the tank. In yet another embodiment the at least one latching mechanism is a gear including a plurality of lugs. In still another embodiment each lug of the plurality of lugs is associated with a different latching state of the center tube. In one embodiment the gear is replaceable with another gear including a different number of lugs, wherein the flush valve device is scalable to different sized tanks based on the number of lugs. In another embodiment the at least one latching mechanism is a hook device. In yet another embodiment rotation of the hook device is associated with a different latching state of the center tube. In still another embodiment the hook device is replaceable with another hook device having a different length, wherein the flush valve device is scalable to different sized tanks based on the length of a hook device. In one embodiment the system further including another latching mechanism, another rack and another float-weight cup to counter the movement of the at least one latching mechanism, the rack and the float-weight cup. In another embodiment the at least one latching mechanism is rotatable in a clockwise and counter-clockwise direction.

Other aspects and advantages will become apparent from the following detailed description, which, when taken in conjunction with the drawings, illustrate by way of example the principles of the embodiments.

The embodiments, now having been briefly summarized, may be better appreciated by the following detailed description.

BRIEF DESCRIPTION OF THE DRAWINGS

For a fuller understanding of the nature and advantages of the embodiments, as well as a preferred mode of use, reference should be made to the following detailed description read in conjunction with the accompanying drawings, in which.

DETAILED DESCRIPTION OF THE PREFERRED EMBODIMENTS

The various embodiments can now be better understood by turning to the following detailed description wherein illustrated embodiments are described. It is to be expressly understood that the illustrated embodiments are set forth as examples and not by way of limitations on the embodiments as ultimately defined in the claims.

Figure 1:
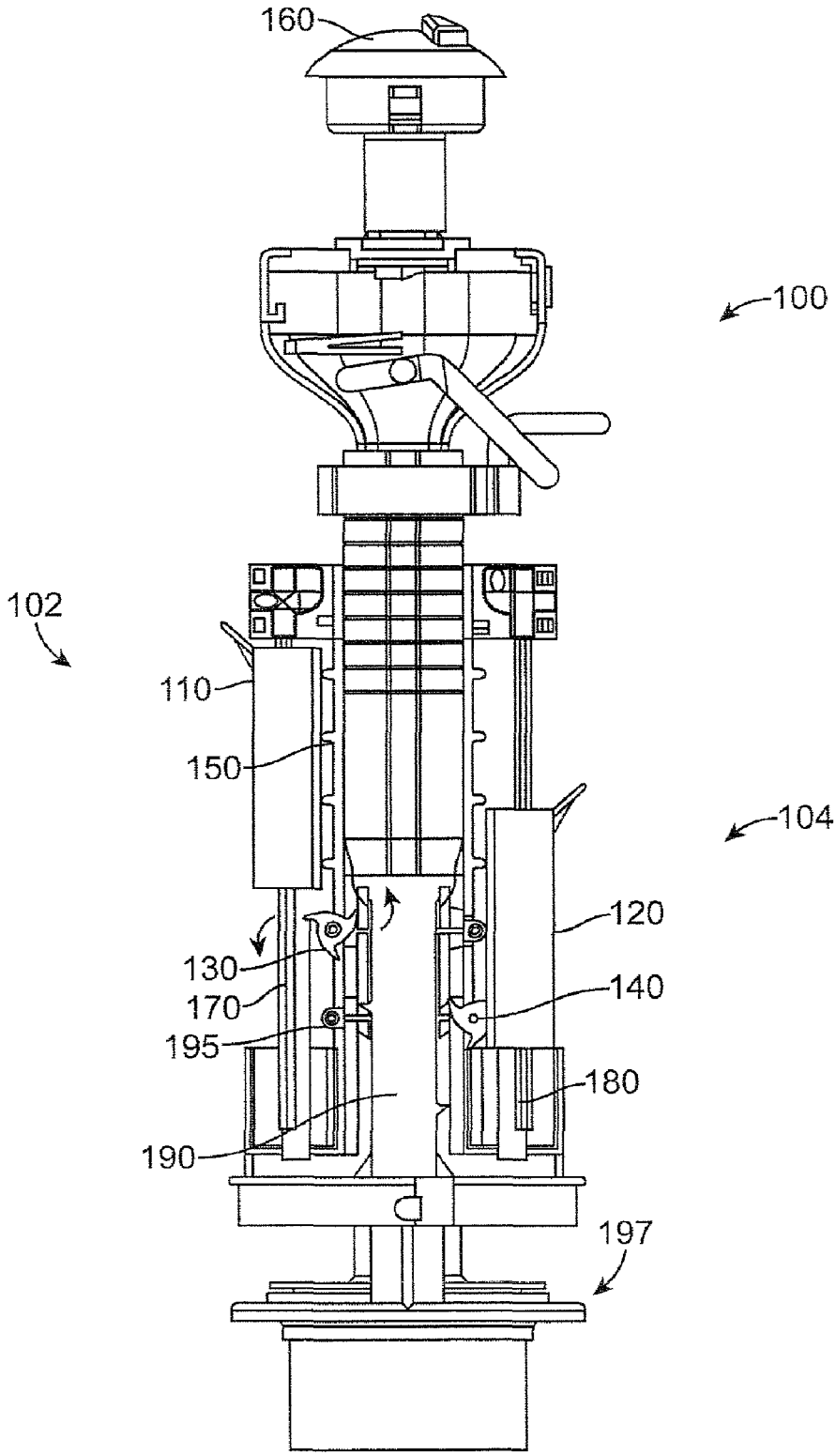
FIG. 1 is an illustration of a flush valve device in accordance with an embodiment.

FIG. 1 illustrates a preferred embodiment of a flush valve device 100. The flush valve device 100 comprises a first flush valve portion 102 including a first float-weight 110, a first latching mechanism 130, a center tube 150 including a lower portion 190 and a lug 195, a flush activation device 160, and a first rack 170. The device 100 is preferably configured for a dual flush toilet and thus comprises a compact, symmetrical design comprising a second flush valve portion 104 including an optional second float-weight 120, an optional second latching mechanism 140, and an optional second rack 180. The second flush valve portion 104 is configured to operate in connection with a second flush option. In one embodiment, the preferred flush valve 100 is included in a toilet system including a tank and a bowl.

In one embodiment, the center tube 150 is initially pulled up using the flush activation device 160, which may comprise a single or dual flush. Pulling up the center tube 150 allows water from a tank (not shown) in which the flush valve 100 is disposed to begin to drain water into a toilet bowl (not shown). This occurs as the seal between the lower portion of the center tube 190 and an opening to the bowl is opened.

Figure 2:
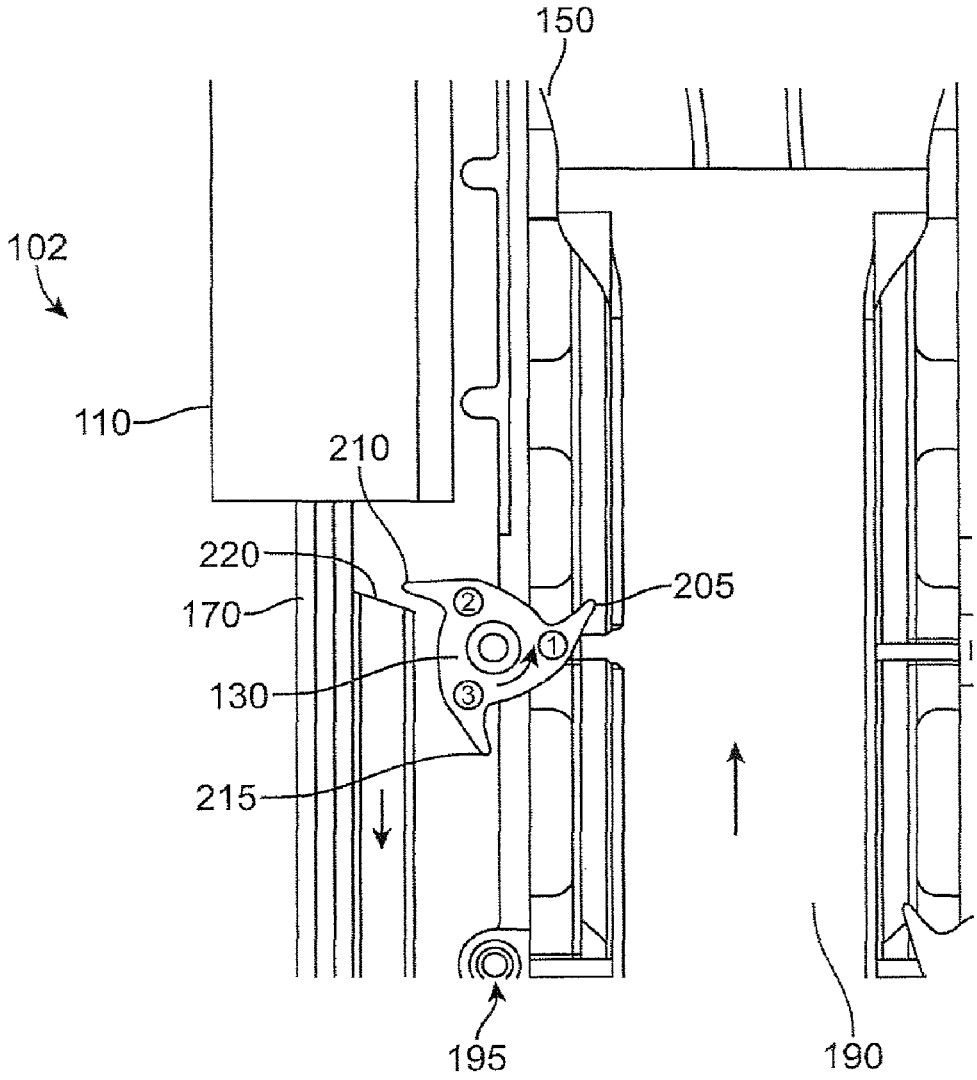
FIG. 2 is an illustration of an isolated view of the flush valve shown in a latching position according to one embodiment.

FIG. 2 illustrates an isolated view of a portion of flush valve 100. In one embodiment, the latching mechanism 130 comprises a gear having lugs 205, 210 and 215. The following description discusses the workings of the flush valve 100 for a first flush valve portion 102 including the first float-weight 110, first rack 170 and first latching mechanism 130. It should be noted that in another embodiment comprising a symmetrical second flush valve portion 104 including the second float-weight 120, the second latching mechanism 140, center tube 150 having an additional lug and second rack 180, the second valve portion 104 works in a similar way when activated by the second flush option of a dual flush activation device. In the preferred embodiment, the second valve portion 104 is positioned symmetrically about the axis of the flush valve 100 to provide another latching means for a flush valve or dual flush valve.

After the initial activation of a flush cycle, a lug 195 of the center tube 150 makes contact with a first latch portion 205 of the first latching mechanism 130. This forces the first latching mechanism 130 to rotate counter clockwise until a second latch portion 210 of the first latching mechanism 130 comes in contact with a cam surface 220 of the first rack 170, which is being pushed upward by the buoyancy of the float-weight 110.

Figure 3:
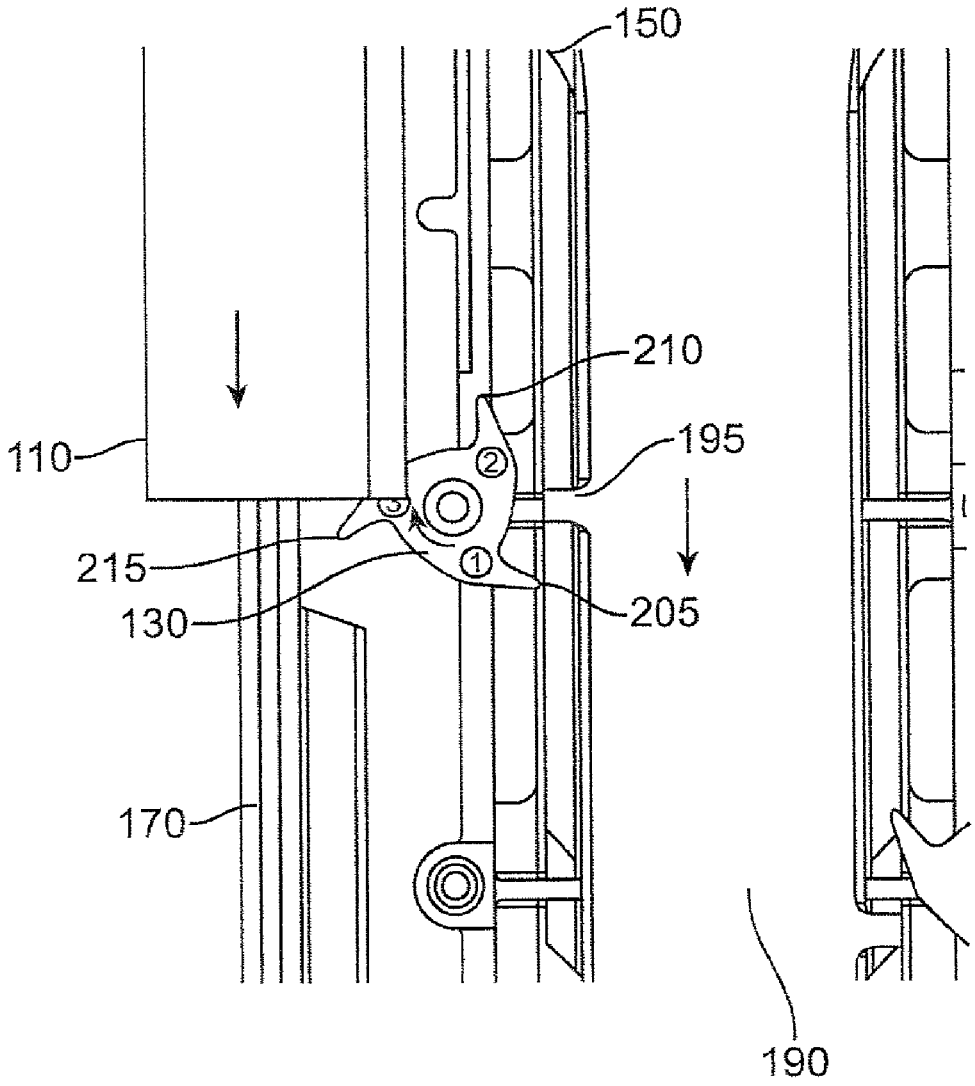
FIG. 3 is an illustration of an isolated view of the flush valve shown in an unlatching position according to one embodiment.

Continuing to pull the center tube 150 upward forces the first latching mechanism 130 to rotate further until a second latch portion 210 pushes the cam surface 220 of the first rack 170 and overcomes the buoyancy from the first float-weight 110 and pushes the float-weight 110 down enough to let the lug 195 on the center tube 150 to pass over to the other side of latch portion 205 of latch mechanism 130. At this point the center tube 150 is released. The dynamic force of fluid flow in the tank and gravity will pull the center tube 150 down, causing the lug 195 to latch on latch portion 205 of the first latching mechanism 130. As a result, the first latching mechanism 130 is now being urged to rotate clockwise until one side of latch portion 215 comes into contact with the wall of the first rack 170 as illustrated in FIG. 3.

At this point, the clockwise moment caused by the center tube 150 is balanced by the clockwise movement of the first latching device 130 caused by the normal force from the first rack 170 per Newton's second law. The fluid level in the tank continues to drop until it reaches the bottom of the first float-weight 110. The first float-weight 110, due to gravity, will drop down pulling the first rack 170 down at the same time. The first rack 170 slides past the third latch portion 215 against the friction force between the first rack 170 and the latching mechanism surfaces, and no longer provides support for the first latching mechanism 130 from the clockwise rotation. This motion of the first latching mechanism 130 unlatches the lug 195 of the center tube 150, causing it to fall down and seal off the flush valve 100.

Figure 4:
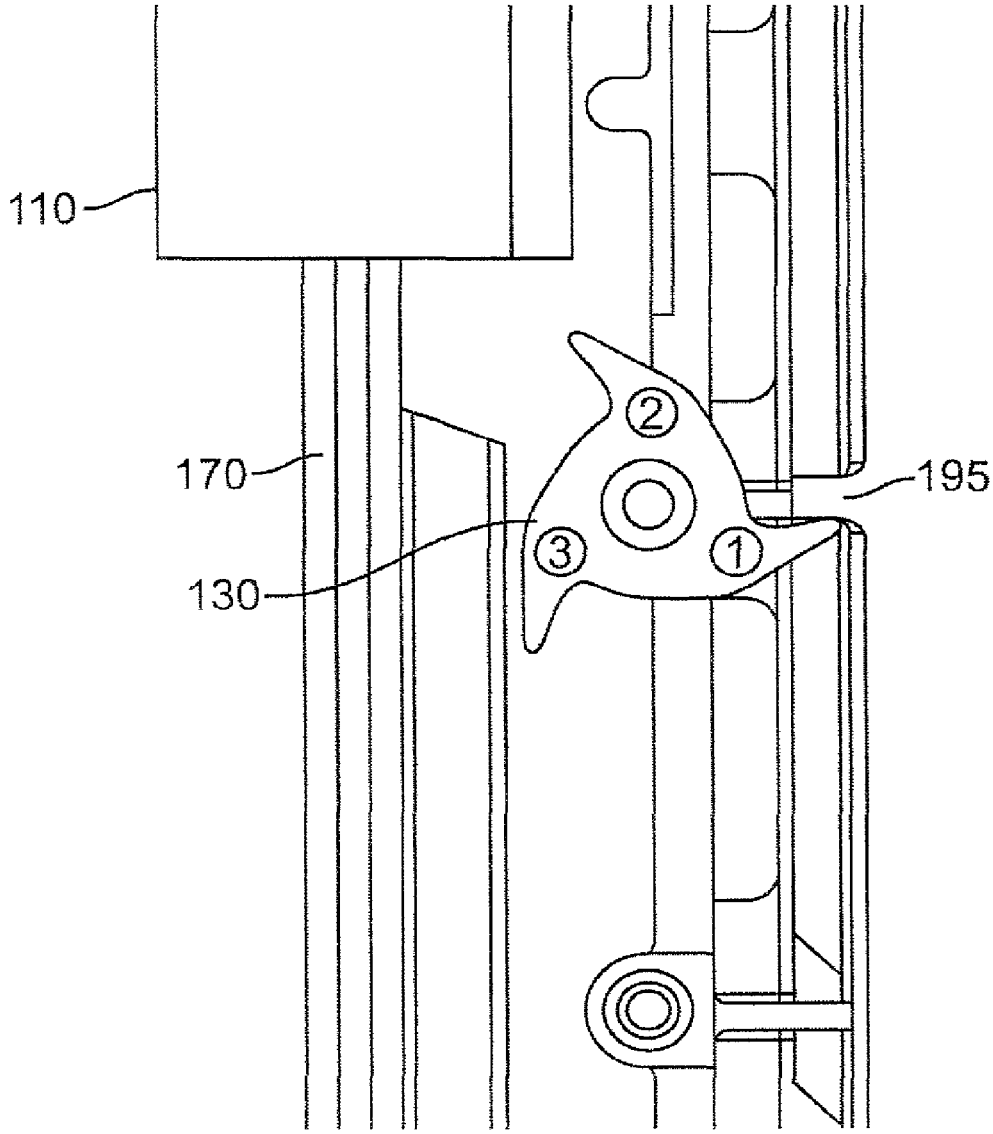
FIG. 4 is an illustration of an isolated view of the flush valve shown in a locking position according to one embodiment.

Fluid in the tank then fills up. When the fluid level reaches the first float-weight 110, buoyant force of the fluid will push the first float-weight 111 up again. The fluid level will rise until a pre-set level is reached and the fluid will cease to flow. As illustrated in FIG. 4, the first latching mechanism 130 is now set to a locked state. In this state, the flush valve 100 is ready to enter a new flush cycle and flush the toilet again.

It will be appreciated that the first float-weight 110 and the first rack 170 collectively work in conjunction with the first latching mechanism 130 to operate as a timing, or delay, mechanism to hold up the center tube 150, and thus keep open the seal 197, until such time that the water level in the tank drops to a certain level, thereby causing the first latching mechanism 130 to disengage from, or unlatch, the center tube 150 so as to enable to the seal 197 to close.

It will also be appreciated that by providing the flush valve 100 with two substantially similar flush valve portions 102, 104 positioned symmetrically about the flush valve axis, a dual flush valve 100 is provided with one of the two flush valve portions 102, 104 configured to operate in connection with a partial flush, and the other of the two flush valve portions 102, 104 configured to operate in connection with a full flush. By using substantially similar structures in the preferred embodiment, the float-weights, 110, 120, latching mechanisms 130, 140, and racks 170, 180 are interchangeable with each other for use with either of the two flush valve portions 102, 104. This provides simplicity and reduced costs in manufacturing, and ease of use as the installer or user need only to adjust the heights of the float-weights 110, 120 to configure each flush valve portion 102, 104 for partial and full flush.

Figure 5:
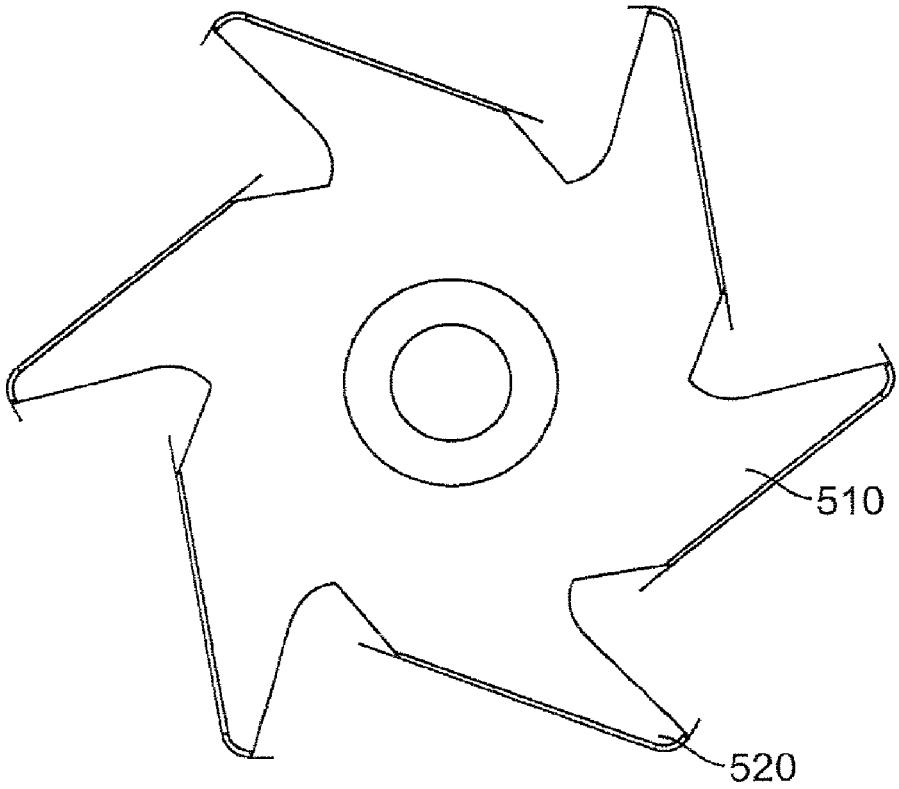
FIG. 5 is an illustration of an isolated view of a gear with additional lugs according to still another embodiment.

FIG. 5 illustrates another embodiment including latching mechanism 510 including latch portions 520. In this embodiment, the latching mechanism 510 includes more latch portions 520 than the first latching mechanism 130. In this embodiment, the latching mechanism 520 can replace the first latching mechanism 130 and provide different strokes to latch and unlatch for different applications. In the example of latching mechanism 510, the change from three latch portions as with the first latching mechanism 130 reduces the stroke to half. This makes it relatively easy to change a latching mechanism so that the flush valve can be used for different sized tanks, different volume flow, etc.

Figure 6:
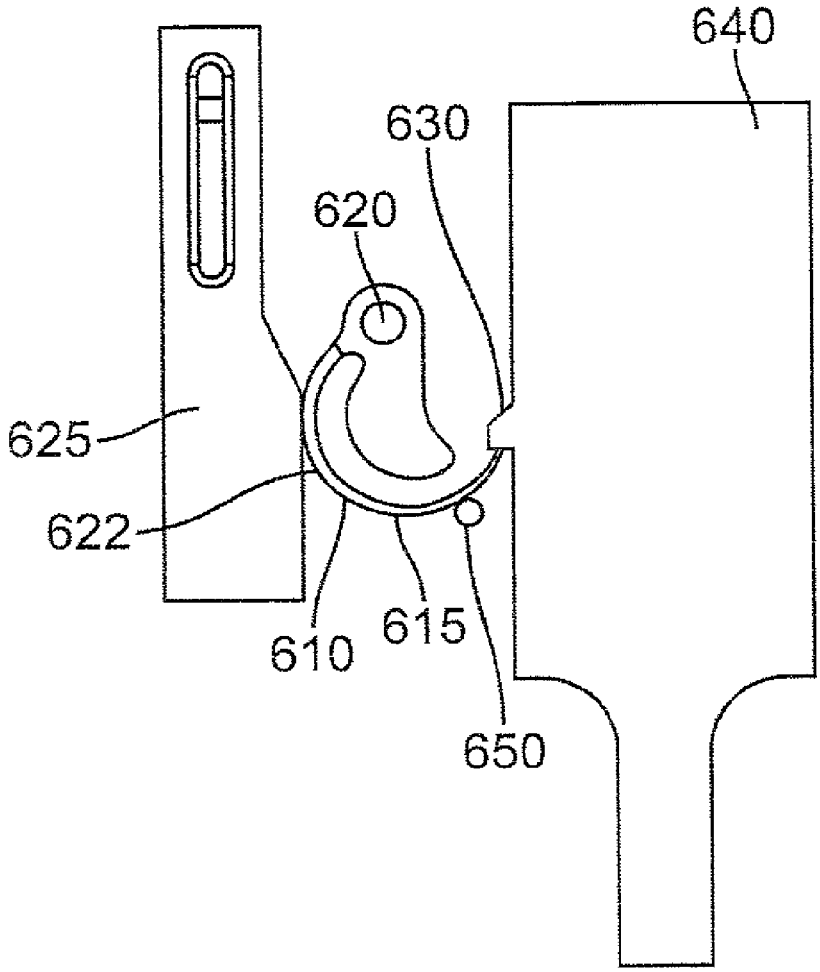
FIG. 6 is an illustration of an isolated view of another embodiment using a hook mechanism.

FIG. 6 illustrates another preferred embodiment of a flush valve 100 including a latching mechanism 610. In this embodiment, the latching mechanism 610 is a rotatable hook shaped device. In use, this embodiment works similarly as with first latching mechanism 130. In this embodiment, latching mechanism 610 has a center of gravity such that it is hung in a vertical position, pivoted about the upper pivot center 620. Latching mechanism 610 includes a long arm portion 615 that works as a coil spring with its end to latch the lug 630 of the lower portion of the center tube 640 and its side to lean against the rack 625. When the center tube 640 is pulled up, the upper surface of its lug 630 comes into contact with the long arm portion 615 of the latching mechanism 610, bending or deflecting the long arm portion 615 away. The lug 630 will then snap over the long arm portion 615 of latching mechanism 610.

When the center tube 640 is released, the lug 630 of the center tube 640 will latch to the end of the long arm portion 615, holding the center tube 640 up. The dynamic force from fluid flow in the tank and force due to gravity on the center tube 640 will force the latching mechanism 610 to rotate clockwise until a side 622 of the long arm portion 615 comes in contact with the rack 625. At this point an equilibrium state for the latching mechanism 610 is achieved. A pin 650 is placed right beneath the long arm portion 615 to prevent the long arm portion 615 from being deflected too much due to the forces from the center tube 640. Fluid level in the tank continues to drop until it reaches beneath the bottom of the float-weight (such as the first float-weight 110). The float-weight will drop due to its weight, pulling the rack 625 down against the friction force between the rack 625 and the latching mechanism 610. At this position, the rack 625 is no longer supporting the latching mechanism 610, causing it to rotate clockwise and to unlatch the center tube 640.

The center tube 640 will then drop down into a sealing position. When the fluid reaches the float-weight, buoyant force of the fluid will push the float-weight up. Fluid in the tank is then filled up to a preset level and the supply of fluid then ceases. The tank is then ready for another flush cycle. Another embodiment adds an identical or similar set including a float-weight, a rack, center tube lug and latching mechanism and can be positioned symmetrically about the axis of the flush valve 100 to provide another latching means for a flush valve or dual flush valve.

Figure 7:
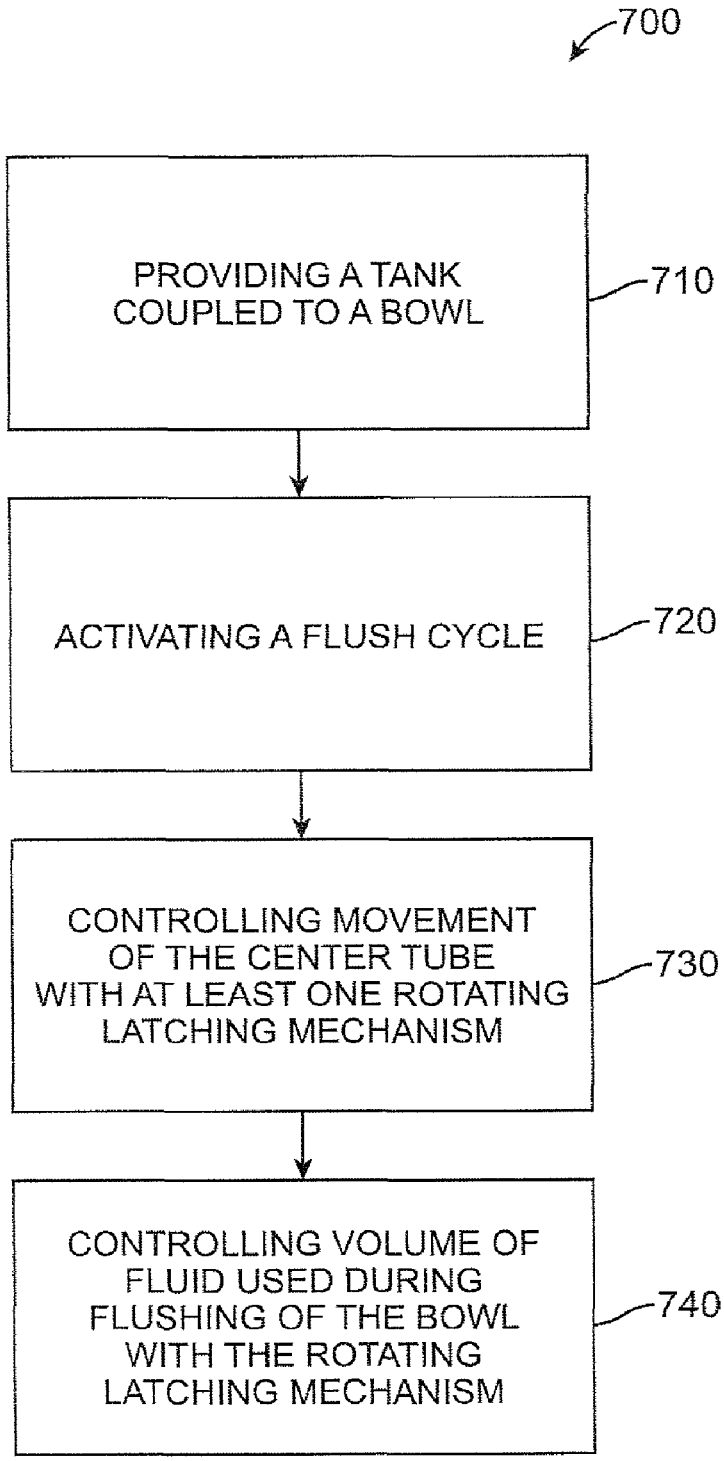
FIG. 7 illustrates a block diagram of a method for flushing a toilet.

FIG. 7 illustrates a block diagram of a method 700 for flushing fluid in a toilet. Method 700 begins with block 710 with providing a tank coupled to a bowl. In this embodiment, different size tanks can be provided based on a selected latching mechanism, such as first latching mechanism 130, second latching mechanism 140, and latching mechanism 610. In block 720, the method 700 includes activating a flush cycle by initially raising a center tube in the tank. This is achieved, for example, pressing a flush button, closing a flush switch, or pressing on a lever.

In block 730, method 700 continues by controlling movement of the center tube with at least one rotating latching mechanism. In this embodiment, the latching mechanism comprises, for example, the first latching mechanism 130, second latching mechanism 140, and/or latching mechanism 610. In block 740, method 700 then provides for controlling volume of fluid used during flushing of the bowl with the rotating latching mechanism.

In one embodiment, the at least one rotating latching mechanism is a gear including a plurality of lugs. In another embodiment, each lug of the plurality of lugs is configured to control a different latching state of the center tube. In yet another embodiment, the gear is replaceable with another gear including a different number of lugs. In one embodiment, the at least one latching mechanism is a hook shaped device. In still another embodiment, rotation of the hook shaped device controls different latching states of the center tube. In another embodiment, the hook shaped device is replaceable with another hook shaped device having a different perimeter length.

Advantageously, the embodiments provide a device, system and method that provides a unique locking method to hold the center tube up with a relatively small amount of buoyant force required from the first float-weight 110 and the second float-weight 120. The first float-weight 110, however, does need some weight to overcome the frictional force that is only a fraction of the total force exerted on the locked center tube 150 to unlatch the first latching mechanism 130. This allows the flush valve 100 to be made smaller than typical flush valves and still provide the same functions. Because of the unique latching mechanism embodiments, the flush valve 100 is scalable for larger flush valves without requiring a redesign. Due to the fact that flush valve 100 can fit into a smaller foot print, flush valve 100 is adaptable to fit into tanks of various sizes.

Many alterations and modifications may be made by those having ordinary skill in the art without departing from the spirit and scope of the embodiments. Therefore, it must be understood that the illustrated embodiments have been set forth only for the purposes of examples and that they should not be taken as limiting the embodiments as defined by the following claims. For example, notwithstanding the fact that the elements of a claim are set forth below in a certain combination, it must be expressly understood that the embodiments include other combinations of fewer, more or different elements, which are disclosed above even when not initially claimed in such combinations.

The words used in this specification to describe the various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the embodiments.

What is claimed is:

1. A flush valve apparatus for flushing a toilet bowl, comprising:

a center tube having a lug;

a flush activation device configured to initially raise the center tube;

at least one latching mechanism configured to control movement of the center tube, wherein the at least one latching mechanism comprises a gear including a plurality of lugs; and at least one rack configured to have movement controlled by the at least one latching mechanism, wherein the at least one latching mechanism controls volume of fluid used during a flush, and wherein the gear is replaceable with a second gear including a different number of lugs.

2. A flush valve apparatus for flushing a toilet bowl, comprising:

a center tube having a lug;

a flush activation device configured to initially raise the center tube;

at least one latching mechanism configured to control movement of the center tube, wherein the at least one latching mechanism comprises a hook device; and at least one rack configured to have movement controlled by the at least one latching mechanism, wherein the at least one latching mechanism controls volume of fluid used during a flush, and wherein rotation of the hook device is associated with a different latching state of the center tube.

3. A flush valve apparatus for flushing a toilet bowl, comprising:

a center tube having a lug;

a flush activation device configured to initially raise the center tube;

at least one latching mechanism configured to control movement of the center tube, wherein the at least one latching mechanism comprises a hook device; and at least one rack configured to have movement controlled by the at least one latching mechanism, wherein the at least one latching mechanism controls volume of fluid used during a flush, and wherein the hook device is replaceable with a second hook device having a different length.

4. A flush valve apparatus for flushing a toilet bowl, comprising:

a center tube having a lug;

a flush activation device configured to initially raise the center tube;

at least one latching mechanism configured to control movement of the center tube; and at least one rack configured to have movement controlled by the at least one latching mechanism, wherein the at least one latching mechanism controls volume of fluid used during a flush;

a float-weight coupled to the rack; and a second latching mechanism, a second rack and a second float-weight cup.

* * * * *